US007011116B2

(12) United States Patent
Krumm

(10) Patent No.: US 7,011,116 B2
(45) Date of Patent: Mar. 14, 2006

(54) TERRY WEAVING METHOD FOR CREATING VARIABLE LOOP HEIGHTS AND A TERRY LOOM FOR CARRYING OUT SAID METHOD

(75) Inventor: Valentin Krumm, Hergensweiler (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 31 days.

(21) Appl. No.: 10/504,261

(22) PCT Filed: Jan. 29, 2003

(86) PCT No.: PCT/DE03/00226

§ 371 (c)(1),
(2), (4) Date: Aug. 9, 2004

(87) PCT Pub. No.: WO03/066946

PCT Pub. Date: Aug. 14, 2003

(65) Prior Publication Data

US 2005/0081938 A1 Apr. 21, 2005

(30) Foreign Application Priority Data

Feb. 7, 2002 (DE) ..... 102 04 945

(51) Int. Cl.
*D03D 39/22* (2006.01)

(52) U.S. Cl. ..... 139/26; 139/190

(58) Field of Classification Search ..... 139/26, 139/190, 189, 188 R, 27, 191
See application file for complete search history.

(56) References Cited

U.S. PATENT DOCUMENTS

| | | | | |
|---|---|---|---|---|
| 3,688,808 | A * | 9/1972 | Uehara et al. | 139/190 |
| 4,566,498 | A * | 1/1986 | Williams et al. | |
| 5,058,628 | A * | 10/1991 | Spiller et al. | |
| 5,404,916 | A * | 4/1995 | Mueller et al. | 139/116.2 |
| 5,423,354 | A * | 6/1995 | Herrlein | 139/26 |
| 6,065,503 | A * | 5/2000 | Berktold et al. | |
| 6,230,758 | B1 * | 5/2001 | Krumm et al. | 139/188 R |
| 6,367,511 | B1 * | 4/2002 | Wahhoud et al. | 139/25 |
| 6,390,144 | B1 * | 5/2002 | Wahhoud et al. | 139/25 |
| 6,418,972 | B1 * | 7/2002 | Krumm et al. | 139/188 R |

FOREIGN PATENT DOCUMENTS

| | | | |
|---|---|---|---|
| EP | 0350446 | * | 1/1990 |
| EP | 0892100 | * | 1/1999 |

* cited by examiner

*Primary Examiner*—John J. Calvert
*Assistant Examiner*—Robert H Muromoto
(74) *Attorney, Agent, or Firm*—W. F. Fasse; W. G. Fasse

(57) ABSTRACT

A terry weaving method and a terry loom for carrying out the method. Subject matter of the terry weaving method is that a slay travel shortening does not result during the carrying out of partial beat-ups for the formation of a weft thread group, and thus the original weft thread insertion window remains maintained. The terry loom has a servo drive (7) that displaces the reed support shaft (4) in the direction of the shed forming means by at least the pre-beat-up distance (VD) while maintaining the basic stroke H of the reed (11) before the forming of the weft thread group, and that reverses or undoes the displacement by at least the pre-beat-up distance (VD) after the forming of the weft thread group.

14 Claims, 2 Drawing Sheets

Figure 1:
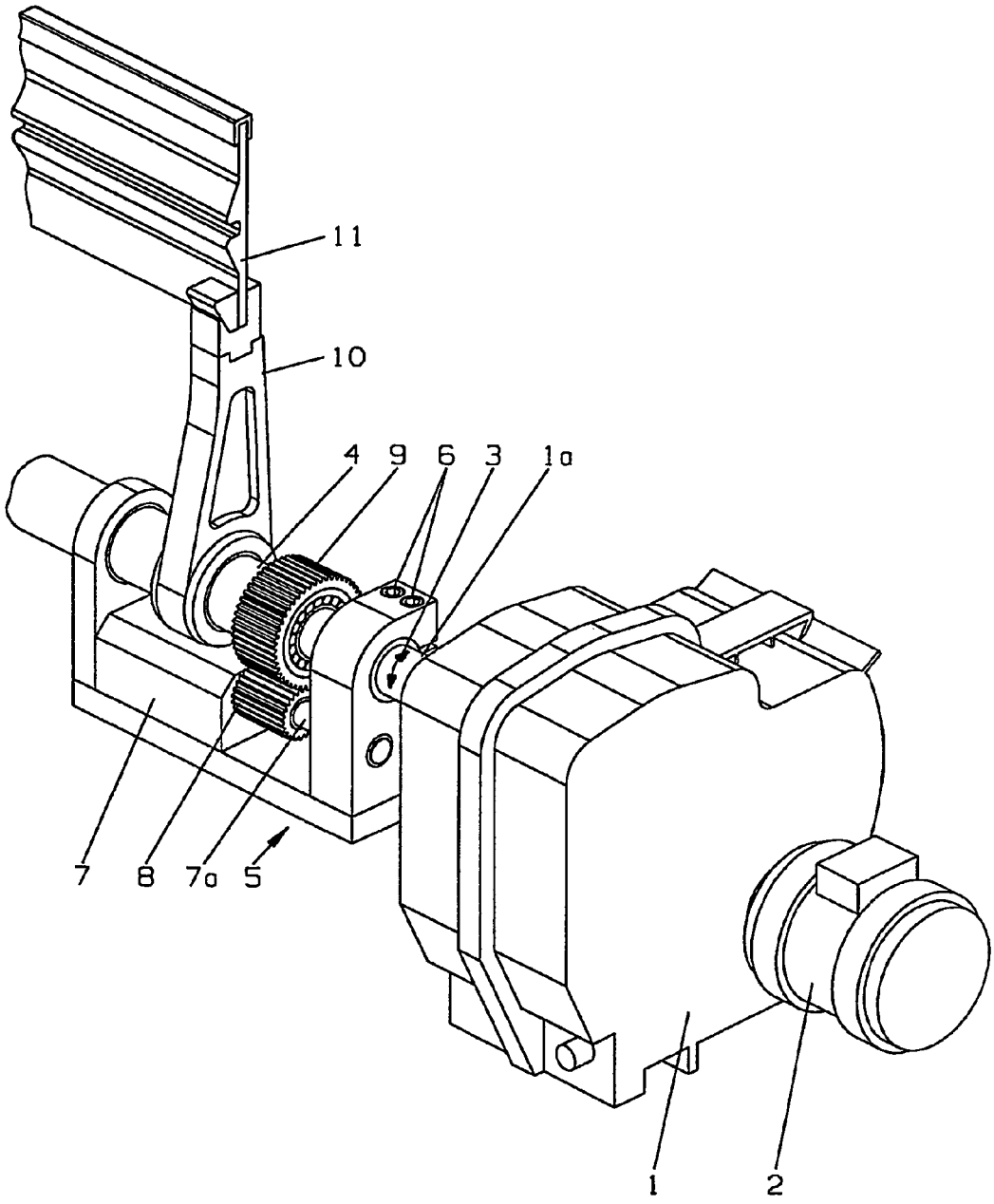

TERRY WEAVING METHOD FOR CREATING VARIABLE LOOP HEIGHTS AND A TERRY LOOM FOR CARRYING OUT SAID METHOD

The invention relates to a terry weaving method for producing a terry fabric with variable loop heights in the terry fabric, wherein a loom shed consisting of ground warp threads and pile warp threads is formed in a first work step, wherein weft threads are inserted into the loom shed in a second work step, wherein each inserted weft thread is partially beat-up and the weft threads thereby form a weft thread group in a third work step, which weft thread group takes up a pre-beat-up distance or preliminary beating distance relative to the beat-up edge of the terry fabric, and wherein the reed, while carrying out a basic or ground stroke, beats up the weft thread group against the beat-up edge of the terry fabric while forming pile loops with the pile warp threads in a fourth work step.

The invention further relates to a terry loom for carrying out the terry weaving method, including at least one support for a reed connected with a reed support shaft as pile forming means, at least one electric motor drive, of which the rotation is converted into a forward and backward rotation having a limited rotational angle and is transmitted to an output shaft of at least one transmission that comprises a complementary cam set, means for transmitting the rotational-angle-limited forward and backward rotation to the reed support shaft, whereby one of the means is at least one controllable servo drive, that is freely controllably activatable via an electronic control.

A terry weaving method and a loom with pile forming organs is known from the European Patent 0 350 446 B1. The European Patent discloses two different technologies for producing a terry fabric. The first technology includes the production of a terry fabric with variable pile height through control of the batten or slay as a pile forming organ by means of a servo motor as a separate drive. The second technology includes the production of a terry fabric by control of the fabric in that fabric control organs, such as a tensioning or temple beam and a breast beam as pile forming organs, are controllably activated by at least one servo motor.

The subject matter of the present patent application is the technology for producing a terry fabric through controlled adjusting or displacing of the reed support shaft.

In the EP 0 350 446, the batten or slay as a pile forming organ is controlled through transmission elements for forming a variable pile height. Thereby, the formation of a weft group is associated with the disadvantage that the travel of the slay and therewith the travel of the reed for partial beat-ups is correspondingly shortened in comparison to the complete or full beat-up, and the original stroke is again caused only when the weft thread group is to be beat-up. A shortening of the weft thread insertion window necessarily follows or goes along with the shortening of the slay travel, in other words, with the formation of the weft thread group, which takes up a so-called preliminary beating distance or pre-beat-up distance at a relative spacing to the beat-up edge of the fabric, the geometry of the loom shed varies in the sense of a shortening with every weft thread that is inserted into the loom shed and bound in or interlaced.

With the loom shed that becomes smaller from weft thread insertion to weft thread insertion, in gripper looms it can actually give rise to the obstruction or hindering of the weft thread insertion itself. In air jet looms, this circumstance leads to a premature covering of the relay nozzles supporting the weft thread insertion.

Apparatuses for changing the beat-up adjustment or setting of a reed and a loom with such an apparatus are known from the EP 0 892 100 A1. The slay swords are supported on an axis or axle and driven in a pivotable movable manner about this axis or axle. In this context, the basic motion of the slay swords carrying the reed is always uniformly large or the same size. For producing a terry fabric, however, it is necessary to form a so-called pre-beat-up group. For this purpose, an apparatus for changing the beat-up adjustments or settings of the reed is mounted on the slay swords, wherein this apparatus has a drive independent of the drive of the slay swords, which drive is connected via a gearing or transmission and transmission elements with a reed pivot axis or axle at the free end of the slay swords. Thereby, the transmission elements are selectively embodied as a kinematic chain, as a belt drive or as a toothed gear drive. Each one of the additional apparatuses for changing the beat-up adjustments or settings of the reed on the one hand has the effect of increasing costs, and on the other hand the mass moved with the slay swords and the reed is increased in an undesired manner, which can lead to a limitation of the capacity of the loom.

It is an object of the invention to provide a terry weaving method for producing a terry fabric with variable loop heights in the terry fabric, whereby the method is based on the technology of the controlled readjustment or displacement of the reed support shaft, and it is further an object of the invention to present a terry loom for carrying out the method.

A slay travel shortening in the formation of the weft thread groups, as known from EP 0 350 446, is to be excluded with the inventive method and the terry loom, in order to cause no limitation of the weft thread insertion window, that is to say no shortening of the loom shed. Furthermore, the reed supports shall not carry out an oscillating back and forth pivoting motion about an axis, as disclosed in EP 0 892 100 A1, and the reed shall not be changed in its position relative to the reed supports by an additional apparatus for the formation of a weft thread group.

According to the invention, the object is achieved according to the terry weaving method, in that, before the forming of the weft thread group, the reed support shaft is readjusted or shifted or displaced by a prescribed amount of a pre-beat-up distance (VD) in the direction of or toward the means forming the loom shed while maintaining the basic stroke H of the reed, and this readjustment or shifting or displacement is again reversed or canceled or undone by the prescribed amount of the pre-beat-up distance before each total or complete beat-up of a weft thread group.

In a particular embodiment of the inventive method, at least one displacement is carried out after the forming of the pre-beat-up distance in a single weft manner, that is to say a displacement of the reed support shaft in the sense of the maintaining of the original shed geometry can be carried out per partial beat-up of the weft thread for the forming of a weft thread group. Only after the desired weft thread group is realized with a prescribed pre-beat-up distance, the displacement is reversed or undone, namely preferably in the reversed end position of the reed. Subsequently, the weft thread group is beat-up by the reed against the beat-up edge while carrying out the basic slay travel (H).

For carrying out the inventive terry weaving method, at least one transmission means is connected directly with the output shaft of a gearing or transmission on the one hand, and on the other hand the transmission means is indirectly connected with the reed support shaft. That is to say, the oscillating rotational motion of the output shaft of the transmission is not transmitted directly to the reed support shaft. An electric servo motor is provided as a separate drive for readjusting or displacing the reed support shaft with reed by a prescribed amount of the pre-beat-up distance and for the single-weft-wise readjustment or displacement, wherein the drive shaft of the electric servo motor carries a pinion gear, which meshes with a toothed gear wheel arranged rotationally securely or fixedly on the reed support shaft.

For readjusting or displacing the reed shaft, thus the electric servo motor is controlledly activated in such a manner so that a pre-beat-up distance is formed and so that a readjusting or displacing can be carried out in a single weft manner and a weft group manner. The readjustment or displacement is effectuated via the pinion gear and the toothed gear wheel, whereby the pinion gear and the toothed gear wheel form a reducer or step-down gearing.

With the inventive solution, in an advantageous manner in the formation of the weft thread group, the reed stroke is not shortened, whereby the weft thread insertion window remains maintained in its original size for multi-pick goods, for example four-pick goods. As in the known terry weaving method, fabrics with different pile heights can be realized, which are adjustable in a stepless manner via the controllable servo drive from a minimum to a maximum height. Due to the fact that the servo drive together with the means transmitting the reed motion form a compact structural unit, this is suitable in a particular or special manner as a mass compensation for the mass formed by reed support and reed.

In the following, the invention shall be explained in further detail in connection with an example embodiment.

Figure 2:
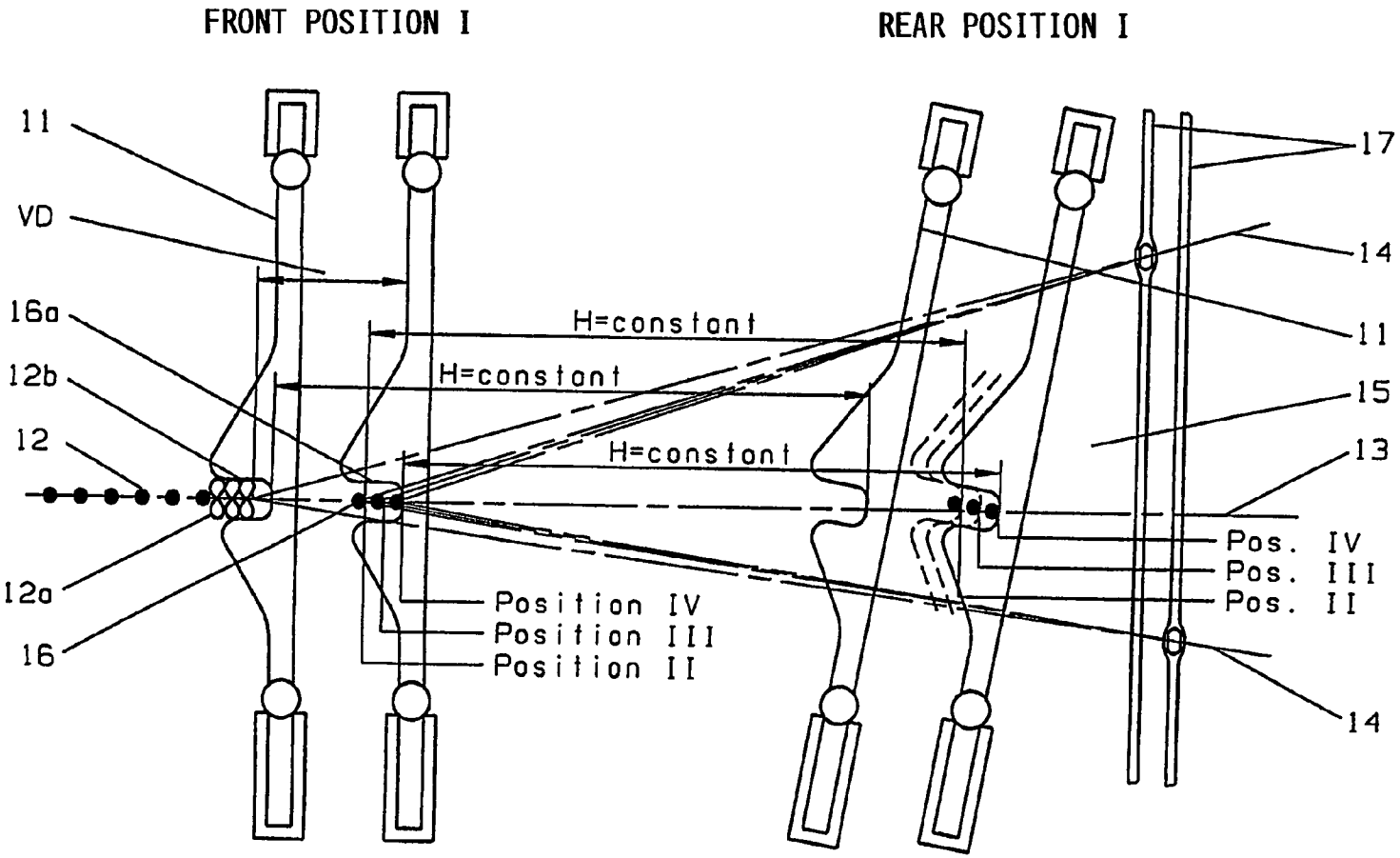

In the accompanying drawings, it is shown by:

FIG. 1 the perspective view of the drive connection between transmission output shaft and reed shaft with operative connection between adjustment or displacement and transmission means, FIG. 2 the reed in full beat-up position of a weft thread group, the reed in the rearward or reverse position for carrying out a full beat-up with constant reed stroke (H), the reed in partial beat-up position of the weft thread, and the reed in the rearward or reverse position for carrying out a partial beat-up with constant reed stroke.

For carrying out a forward and backward rotation with a limited rotational angle according to double arrow 3 of the output shaft 1*a* of a transmission or gearing 1 connected with an electric motor 2, this transmission or gearing 1 is equipped in a known manner with a set of complementary cam disks that are not shown.

The cam surface progression of the disks is followed or sensed by a roller lever. The motion of the roller lever resulting from this following or sensing is transmitted to the output shaft 1*a* of the transmission or gearing 1, and is perceivable as a forward and backward rotation limited in the rotational angle, as is indicated by the double arrow 3.

For transmitting the rotational-angle-limited forward and backward rotation of the output shaft 1*a* to the reed support shaft 4, a first transmission means 5 is provided, which is connected with the output shaft 1*a* in a manner fixed with respect to rotation, for example by means of clamping or tightening screws 6.

A servo drive 7 is combined with the transmission means 5 into a structural unit. In the present example, the servo drive 7 is an electric motor drive, of which the drive shaft 7*a* carries a pinion gear 8. Furthermore, the free end of the drive shaft 7*a* is rotatably movably supported in the vertically downward extending wall of the transmission means 5. The pinion gear 8 is engaged with a toothed gear wheel 9 that is arranged in a manner fixed against rotation on the reed support shaft 4 that is oriented axis-parallel to the drive shaft 7*a* of the drive 7. In that context, the reed support shaft 4, according to the invention, is a shaft separate from the output shaft 1*a* of the transmission 1. At least one support 10 for the reed 11 is connected in a manner fixed against rotation with the reed shaft 4.

The manner of operation of the inventive solution is as follows:

The output shaft 1*a* carries out a motion limited in its rotational angle, according to the double arrow 3, corresponding to the cam progression of the complementary cam set present within the transmission 1. Plural reed supports 10 carrying the reed 11 are connected, in a manner fixed against rotation, with the reed support shaft 4.

The rotational moment or torque of the output shaft 1*a* is transmitted from the transmission means 5 via the drive 7 rigidly connected with the transmission means 5 and via the drive means 8, 9 to the reed support shaft 4. Thereby, the reed 1 carries out an oscillating stroke motion lying between the forward position I and the rear position I with a constant stroke H, also see FIG. 2.

In the production of a terry fabric it is generally known to form a so-called weft thread group 16*a* consisting of plural weft threads 16 that are bound-in or interlaced by the warp threads 13, 14. This weft thread group must take up a predetermined distance relative to the beat-up edge 12*b* of the woven web or fabric 12. This distance is referred to as the preliminary beating distance or pre-beat-up distance VD.

For forming the weft thread group, it is necessary to adjust the reed to this pre-beat-up distance VD. Depending on the number of the weft threads in the weft thread group, subsequently the reed position is varied or changed in a single weft manner or in a weft group manner. According to the invention, the constant stroke H of the reed is not reduced when adjusting or changing the position of the reed. The adjusting is achieved in that, preferably in the rear position I of the reed 11, the servo drive is controlledly activated and thereby the reed support shaft 4 is readjusted or displaced via the drive means 8, 9 by a few degrees of rotational angle in the direction of or toward the means 17 forming the loom shed 14, and namely initially by the amount VD, and thereafter weft insertion for weft insertion, that is to say in a single weft manner, for example in the rear positions II, III and IV, see FIG. 2.

After the forming of the weft thread group, the drive 7 is controlledly activated anew, and the reed support shaft 4 is displaced back or in reverse by the sum of the degrees of rotational angle effectuating the readjustment or displacement, so that the reed 11 again takes up the rear position I and from this position beats-up the weft thread group against the web or fabric edge 12*b*. This method sequence is repeated so long until, for example, an edging or border is woven corresponding to the pattern control of the loom.

The invention claimed is:

1. Terry weaving method for producing a terry fabric with variable loop height (12*a*) in the terry fabric (12), wherein a loom shed (15) consisting of ground warp threads (13) and pile warp threads (14) is formed in a first work step, wherein weft threads (16) are inserted into the loom shed (15) in a second work step, wherein each inserted weft thread (16) is partially beat-up and the weft threads (16) thereby form a weft thread group (16*a*) in a third work step, which weft thread group takes up a pre-beat-up distance (VD) relative to the beat-up edge (12*b*) of the terry fabric (12), and wherein the reed (11), while carrying out a basic stroke (H), beats up the weft thread group (16*a*) against the beat-up edge (12*b*)

of the terry fabric (12) while forming pile loops (12*a*) with the pile warp threads (14) in a fourth work step, characterized in that, before the forming of the weft thread group (16*a*) the reed support shaft (4) is displaced by at least a rotational angle amount in the direction of the loom shed (15) forming means (17) in such a manner so that the basic stroke (H) of the reed (11) remains maintained in the forming of the weft thread group (16*a*), and in that, after the forming of the weft thread group (16*a*), the displacement of the reed support shaft (4) is reversed or undone by this rotational angle amount.

2. Terry weaving method according to claim 1, characterized in that the rotational angle displacement amount corresponds to at least the amount of the pre-beat-up distance (VD) of the weft thread group (16*a*).

3. Terry weaving method according to claim 1, characterized in that the rotational angle displacement for the formation of the weft thread group (16*a*) is carried out controlled in a single-weft-wise manner.

4. Terry weaving method according to claim 1, characterized in that the rotational angle displacement for the formation of the weft thread group (16*a*) is carried out controlled in a weft-group-wise manner.

5. Terry weaving method according to claim 1, characterized in that the reversing or undoing of the rotation angle displacement is carried out controlled in a weft-group-wise manner.

6. Terry weaving method according to claim 1, characterized in that the at least one rotational angle displacement amount and the reversing or undoing thereof is carried out by a servo drive.

7. Terry loom for carrying out the terry weaving method according to patent claim 1, comprising at least one support (10) for a reed (11) connected with a reed support shaft (4) as pile forming means, at least one electric motor drive (2), of which the rotation is converted into a forward and backward rotation having a limited rotational angle and is transmitted to an output shaft (1*a*) of at least one transmission (1) that comprises a complementary cam set, means (5) for the transmitting of the rotational-angle-limited forward and backward rotation to the reed support shaft (4), whereby one of the means is at least one controllable servo drive (7), and an electronic control via which the servo drive (7) is freely controllably activatable, characterized thereby that the reed support shaft (4) is a shaft separated from the output shaft (1*a*) of the transmission (1), that a first suitable transmission means (5) is drive-connected directly with the output shaft (1*a*), and that the transmission means (5) is operatively connected with the reed support shaft (4) via further means (7, 7*a*; 8; 9), whereby the means (7) is the controllable servo drive.

8. Terry loom according to claim 7, characterized in that the transmission means (5) with the servo drive (7) forms a structural unit.

9. Terry loom according to claim 7, characterized in that the servo drive (7) is operatively connected with the reed support shaft (4) via a reduction gearing.

10. Terry loom according to claim 9, characterized in that the reduction gearing is formed of the pinion gear (8) and the toothed gear wheel (9).

11. Terry loom according to claim 1, characterized in that the servo drive (7) is an electric motor drive.

12. Terry loom according to claim 1, characterized in that the servo drive (7) is a hydraulic drive.

13. Terry loom according to claim 1, characterized in that the servo drive (7) is a pneumatic drive.

14. Terry loom according to claim 8, characterized in that the structural unit (5, 7) is effective as mass compensation of reed (11) and reed support (10) during the woven fabric formation.

* * * * *

UNITED STATES PATENT AND TRADEMARK OFFICE

CERTIFICATE OF CORRECTION

PATENT NO. : 7,011,116 B2
APPLICATION NO. : 10/504261
DATED : March 14, 2006
INVENTOR(S) : Krumm It is certified that error appears in the above-identified patent and that said Letters Patent is hereby corrected as shown below:

Column 6,
Line 27, after "claim", replace "1" by --7--;
Line 29, after "claim", replace "1" by --7--;
Line 31, after "claim", replace "1" by --7--.

Signed and Sealed this

Eleventh Day of July, 2006

JON W. DUDAS
*Director of the United States Patent and Trademark Office*